US010555105B2

(12) United States Patent
Rugeles Ospina et al.

(10) Patent No.: US 10,555,105 B2
(45) Date of Patent: Feb. 4, 2020

(54) SUCCESSIVE DECOMPOSITIONS OF AUDIO FILTERS

(71) Applicant: Orange, Paris (FR)

(72) Inventors: Felipe Rugeles Ospina, Rennes (FR); Marc Emerit, Rennes (FR)

(73) Assignee: ORANGE, Paris (FR)

( * ) Notice: Subject to any disclaimer, the term of this patent is extended or adjusted under 35 U.S.C. 154(b) by 0 days.

(21) Appl. No.: 15/780,948

(22) PCT Filed: Nov. 30, 2016

(86) PCT No.: PCT/FR2016/053153
§ 371 (c)(1),
(2) Date: Jun. 1, 2018

(87) PCT Pub. No.: WO2017/093666
PCT Pub. Date: Jun. 8, 2017

(65) Prior Publication Data

US 2018/0288554 A1 Oct. 4, 2018

(30) Foreign Application Priority Data

Dec. 1, 2015 (FR) ..... 15 61637

(51) Int. Cl.
*H04S 7/00* (2006.01)
*H04S 1/00* (2006.01)

(52) U.S. Cl.
CPC ..... *H04S 7/302* (2013.01); *H04S 1/007* (2013.01); *H04S 7/307* (2013.01); *H04S 2420/01* (2013.01)

(58) Field of Classification Search
CPC ..... H04S 7/302; H04S 7/304; H04S 7/307; H04S 1/007; H04S 2420/01
(Continued)

(56) References Cited

U.S. PATENT DOCUMENTS 5,659,619 A * 8/1997 Abel ..... H04S 1/002 381/1
8,768,496 B2 7/2014 Katz et al.
2013/0046790 A1* 2/2013 Katz ..... H04S 3/002 707/792

FOREIGN PATENT DOCUMENTS

FR 2958825 A1 10/2011

OTHER PUBLICATIONS

Evans et al., "Analyzing head-related transfer function measurements using surface spherical harmonics", Oct. 1998, Acoustical Society of America, Journal of the Acoustical Society of America, vol. 104, No. 4, pp. 2400-2411. (Year: 1998).*
(Continued)

*Primary Examiner* — Davetta W Goins
*Assistant Examiner* — Daniel R Sellers
(74) *Attorney, Agent, or Firm* — David D. Brush; Westman, Champlin & Koehler, P.A.

(57) ABSTRACT

The invention relates to a method for processing customized data representative of the directivity of an customized audio system, the method comprising the following steps: —obtaining (101), for each individual of an initial set of individuals, at least one customized suite of filters; —determining (103) N independent components common to the suites of filters obtained; —decomposing (104) each of the suites obtained into a first base constructed from the N independent components with a view to obtaining, for each suite of filters, a first suite of weighting coefficients; —decomposing (105) each first suite of weighting coefficients into a second base of P independent components, so as to obtain a second suite of weighting coefficients; —storing (106) each second suite of weighting coefficients obtained in association with an identifier of an individual from among the initial set of individuals.

12 Claims, 5 Drawing Sheets

(58) Field of Classification Search
USPC ..... 381/310
See application file for complete search history.

(56) References Cited

OTHER PUBLICATIONS

Guillon et al., "Head-Related Transfer Function customization by frequency scaling and rotation shift based on a new morphological matching method", Oct. 2008, Audio Engineering Society, AES 125th Convention, Paper 7550, pp. 1-14. (Year: 2008).*
French Search Report and Written Opinion dated Jul. 7, 2016 for corresponding French Application No. 1561637, filed Dec. 1, 2015.
Daniel, Jerome. "Représentation de champs acoustiques, application à la transmission et à la reproduction de scènes sonores complexes dans un contexte multimédia (Representation of acoustic fields application to transmission and reproduction of complex sound scenes in a multimedia context)." University of Paris 6. Jul. 31, 2001.
Daniel, Jerome. "Représentation de champs acoustiques, application à la transmission et à la reproduction de scènes sonores complexes dans un contexte multimédia (Representation of acoustic fields application to transmission and reproduction of complex sound scenes in a multimedia context)." University of Paris 6. Jul. 31, 2001. English Abstract.
Wen Zhang et al: "Efficient Continuous HRTF Madel Using Data Independent Basis Functions: Experimentally Guided Approach", IEEE Transactions on Audio, Speech and Language Processing, IEEE Service Center, Newyork, NY, USA, vol. 17, No. 4, May 1, 2009 (May 1, 2009), pp. 819-829.
Zhang Wen et al: "Insights into head-related transfer function: Spatial dimensionality and continuous representation", The Journal of The Acoustical Society of America, American Institute of Physics for The Acoustical Society of America, New York, NY, US, vol. 127, No. 4, Apr. 1, 2010 (Apr. 1, 2010), pp. 2347-2357).
Qinghua Huang et al: "A reduced order model of head-related impulse responses based on independent spatial feature extraction", Acoustics, Speech and Signal Processing, 2009. ICASSP 2009. IEEE International Conference on, IEEE, Piscataway, NJ, USA, Apr. 19, 2009 (Apr. 19, 2009), pp. 281-284.
Zotkin D N et al: "Rendering Localized Spatial Audio in a Virtual Auditory Space", IEEE Transactions on Multimedia, Aug. 1, 2004 (Aug. 1, 2004), pp. 553-564.
Spagnol S et al: "On the Relation Between Pinna Reflection Patterns and Head-Related Transfer Function Features", IEEE Transactions on Audio, Speech and Language Processing, IEEE Service Center, New York, NY, USA, vol. 21, No. 3, Mar. 1, 2013 (Mar. 1, 2013), pp. 508-519.
Sohni Ankit et al: "Extraction of pinna spectral notches in the median plane of a virtual spherical microphone array", 2014 4th Joint Workshop on Hands-Free Speech Communication and Microphone Arrays (HSCMA), IEEE, May 12, 2014 (May. 12, 2014).
Ajdler et al: "Dynamic measurement of room impulse responses using a moving microphone", Acoustical Society of America, Jul. 3, 2007 (Jul. 3, 2007), pp. 1636-1645.
Zotkin D N et al: "Fast head-related transfer function measurement via reciprocity", Acoustical Society of America, May 3, 2006 (May 3, 2006), pp. 2202-2215.
Guillon P.: "Individualism des indices spectraux pour la synthese binaurale: recherce et exploitation des similarites interindividuelles pour l'adaptation ou la reconstruction de HRTF", PhD Thesis, Universite du Maine, Le Mans, Jun. 11, 2009 (Jun. 11, 2009).
Dellepiane M et al: "Reconstructing head models from photographs for individualized 3D-audio processing", The Authors, The Eurographics Association and Blackwell Publishing Ltd., vol. 27, No. 7, 2008, pp. 1719-1727.
International Search Report dated Mar. 6, 2017 for corresponding International Application No. PCT/FR2016/053153, filed Nov. 30, 2016.
Written Opinion of the International Searching Authority dated Mar. 15, 2017 for corresponding International Application No. PCT/FR2016/053153, filed Nov. 30, 2016.

* cited by examiner

SUCCESSIVE DECOMPOSITIONS OF AUDIO FILTERS

CROSS-REFERENCE TO RELATED APPLICATIONS

This Application is a Section 371 National Stage Application of International Application No. PCT/FR2016/053153, filed Nov. 30, 2016, the content of which is incorporated herein by reference in its entirety, and published as WO 2017/093666 on Jun. 8, 2017, not in English.

FIELD OF THE DISCLOSURE

This invention relates to the domain of reproduction of sound data.

Its applications are particularly but non-exclusively in the field of telecommunication services offering spatialized sound reproduction, for example as in the case of an audio conference between several speakers, playback of a cinema trailer or playback of any type of multi-channel content. The invention is also applicable to the case of telecommunication terminals, particularly mobile terminals, for which a sound reproduction is envisaged with a stereophonic listening system (for example headphones) by which the listener can position sound sources in space.

To achieve this, the invention makes use of invariable and stationary linear systems that can be characterized by a filter assembly depending on a direction between the sound source and one of the listener's ear canals.

This filter assembly represents the directivity of the system. The filters can be represented in their temporal form (in the form of a pulse response) or frequency form (in the form of a transfer function).

For example, an individual or an artificial head with a microphone at the input to each ear canal are special cases of such an invariable and stationary linear system. In this case, the system can be characterized by its transfer functions specific to each individual.

The transfer functions define the spatial hearing characteristics of the individual, taking account particularly of reflections related to his morphology.

Transfer functions are classically referred to as the HRTF (Head Related Transfer Function) type when the filters are given in the frequency domain, and the HRIR (Head Related Impulse Response) type, when the filters are given in the temporal domain. It is possible to change from one representation to the other using a Fourier transform.

Therefore HRTF transfer functions are a set of complex values. It is possible to return to real values using the moduli of each; the results obtained are thus the moduli of HRTFs.

Division of each modulus by the spatial average of the moduli for a given frequency can give what is commonly called the "Directional Transfer Function" (DTF) in the literature.

The invention can be generalized to directivities of systems with different sensor shapes and/or numbers (for example a mobile telephone with 3 microphones). Without reducing the generalization of the invention to any linear system that can be characterized by ORTFs, and in order to facilitate understanding of the invention, the special case of DTF transfer functions will be considered in the following. We can change from DTF transfer functions to HRTF transfer functions by calculating minimum phase filters associated with DTF transfer functions and adding a delay modelling propagation delays between capsules (inter-aural delay by a human). These delays are personalized using other well-known techniques that are not described herein.

BACKGROUND OF THE DISCLOSURE

One technique using HRTF type transfer functions is binaural synthesis. This technique is based on the use of "so-called" "binaural" filters that reproduce acoustic transfer functions between the sound source(s) and the listener's ear canals. These filters are used to simulate auditive positioning indexes that a listener uses to position sound sources in a real listening situation.

Therefore techniques related to binaural synthesis are based on a pair of binaural signals that are input to a reproduction system. The two binaural systems can be obtained by signal processing, by filtering a monophonic signal by binaural filters that reproduce acoustic propagation properties between the source placed at a given position and each of the listener's ear canals.

Binaural synthesis can be used for different reproductions for example such as reproduction using a headset with two ear phones, or using two loud speakers. The objective is to reconstruct a sound field at the ears of the listener that is practically identical to the sound field that the real sources would have induced in space.

Binaural filters take account of all acoustic phenomena that modify the acoustic waves along their path between the source and the listener's ear canals. In particular, acoustic phenomena include diffraction through the listener's head and reflections on the user's pinna and upper torso.

These acoustic phenomena vary depending on the position of the sound source relative to the listener and the listener can position the source in space through the variations. These variations determine a form of acoustic coding of the position of the source. Through learning, an individual's hearing system can interpret this coding to position the sound source(s).

Nevertheless, acoustic diffraction/reflection phenomena are strongly dependent on the listener's morphology. Therefore a quality binaural synthesis depends on binaural filters that optimize reproduction of the acoustic coding that the listener's body produces naturally, taking account of individual specific features of his or her morphology.

When these conditions are not respected, a degradation of the performances of the binaural rendering is induced, which in particular results in intercranial perception of sources and confusion between forward and rear positions.

Thus, binaural filters represent acoustic transfer functions or HRTF transfer functions that model transformations generated by the user's torso, head and pinna on the acoustic signal originating from a sound source. A pair of HRTF functions is associated with each sound source position, with one for each ear. Furthermore, these HRTF transfer functions carry the acoustic footprint of the morphology of the individual on which they were measured.

In a well-known manner, HRTF transfer functions are obtained during a measurement phase. A selection of directions is fixed more or less precisely covering the entire space surrounding the listener. For each direction, the left and right HRTF transfer functions are measured using microphones inserted at the entry to the listener's ear canals. In general, a sphere centered on the listener is thus defined.

For a good quality measurement, the measurement must be made in an anechoic chamber or soundproof booth, such that only acoustic reflections and phenomena related to the listener are taken into account. Finally, if M directions are measured, the result obtained for a given listener is a database of 2M HRTF type transfer functions (for two auditory channels, right and left) representing each of the source positions for each ear canal. Therefore, these techniques necessitate measurements made directly on the listener. Such a measurement operation takes a very long time because a large number of directions have to be measured.

Thus, some individuals spend many hours in the laboratory to analyze details of the acoustic signature associated with their physiognomy, and their perception capacities of the sound space in three dimensions. These individuals then benefit from binaural listening shaped from the analysis results, providing comfort a high quality sound impression.

Filters personalized to each listener are necessary if this quality and this comfort are to be made available to a larger group of listeners, particularly for services aimed at the general public.

However it is difficult to image that all customers of a service could be measured in soundproof booths (that are rare and expensive). Furthermore, the general public would find it difficult to accept the duration and the discomfort of these measurements.

It is thus desirable to have solutions capable of quickly, reliably and unintrusively providing individual acoustic signatures so that the results obtained in an anechoic chamber on a small number of persons could be generalized to a very large population.

One practical solution that is starting to emerge is to suggest that the user could measure his own HRTF transfer functions in his normal place of listening so as to emulate his listening experience in a studio or in his living room, on headphones. The disadvantages related to this type of solution are related to the fact that only a small number of fixed positions are measured and it becomes difficult to separate information related to the reproduction device itself and the place of listening. Different studies have been dedicated to the production of methods to reduce some practical constraints such as dynamic measurement "*Dynamic measurement of room impulse responses using a moving microphone*", Ajdler, Sbaiz, Vetterli, 2007) or reciprocal measurement, in which the roles of the microphone and the load speaker are inverted ("*Fast head-related transfer function measurement via reciprocity*", Zotkin, Duraiswami, Grassi, Gumerov, 2006). Applications of this solution are limited to professional mixing studios or "home cinema" installations.

Different possibilities offering alternative solutions are explored. A first approach consists of calculating filters starting from acquisition of the listener's morphology and in particular his pinna. Personalization can also be based on the transformation of non-individual HRTF transfer functions extracted from a database including morphologies associated with HRTF transfer functions ("*Individualization des indices spectraux pour la synthèse binaurale: recherche et exploitation des similarites interindividuelles pour l'adaptation ou la reconstruction de HRTF* (*Individualization of spectral indices for binaural synthesis; search for and use of interindividual similarities for adaptation or reconstruction of HRTF*)", Guillon, P, PhD Thesis, University of Maine, Le Mans, France, 2009).

The transformation of HRTF transfer functions to adapt them to a given individual is then controlled by the comparison of morphologies of the pinna taken from the database and the target pinna of the given individual. This comparison is based on a technique for matching of three-dimensional meshes of pinnas. Another method consists of using morphological parameters to create or deform a three-dimensional mesh that will then be used for a detailed calculation and a digital simulation of the individual's HRTF transfer functions, for example by boundary finite elements. It is also possible, starting from morphological parameters of a given individual, to search in a database for a third party individual with similar morphological parameters.

Some approaches propose to use a three-dimensional model of the patient's morphology and more particularly his pinna, and other measurements of users' morphological parameters, as input. One method of acquiring the morphology of the pinna consists of using a three-dimensional scan, but this method is sometimes problematic in that it requires special equipment and also special skills.

Alternative solutions are developed either by deriving three-dimensional scans from a set of photographs ("*Reconstructing head models from photographs for individualized 3D-audio processing*", Dellepiane, Pietroni, Tsingos, Asselot, Scopigno, 2008), or by using methods derived from image processing to obtain three-dimensional meshes starting from a camera and reconstruction techniques ("shape from shading", "shape from structured light") or from Kinect™ type sensors associated with depth analysis techniques.

Other work attempts to develop learning methods that include two opposing approaches.

The first approach consists of studying the capacity of listeners to acquire generic HRTF transfer functions that were not initially adapted for them. On the contrary, the second approach suggests computer learning of the reactions of a user participating in an interactive game or answering an interactive questionnaire. The computer iteratively reconstitutes the set of HRTF transfer functions suitable for the user by observing his positioning performances and/or his replies.

However, the storage of sets of transfer functions and their transmission and loading are complicated because of the amount of data representing each set of transfer functions.

Furthermore, solutions necessary for the personalization of a set of transfer functions to adapt it to a given listener do not yet exist, apart from measurements in a soundproof booth. As explained above, measurements in soundproof booths are complex and expensive in hardware and software resources and in time, and thus cannot be transposed to a large population.

SUMMARY

This invention improves this situation.

A first aspect of the invention to achieve this relates to a method of processing individualized data representative of the directivity of an individualized audio system, the method comprising the following steps:

- for each individual in an initial group of individuals, obtain at least one set of personalized filters;
- determine N independent components common to the sets of filters obtained;
- decompose each of the sets obtained (or their moduli) in a first base created from N independent components so as to obtain a first set of weighting factors for each set of filters (or their moduli);
- decompose each first set of weighting factors in a second base of P independent components, so as to obtain a second set of weighting factors;
- store each second set of weighting factors obtained associated with an individual identifier among the initial group of individuals.

The successive decomposition in a first base of N independent components common to all individuals in the first group, and then in a second base of P independent components advantageously makes it possible to compress the stored data. To achieve this, the numbers P and N of independent components can be chosen as a function of criteria related to the size of stored data and the required precision for the sets of filters.

According to one embodiment of the invention, the second base of P independent components can be an order P spherical harmonics base and the second set of weighting factors can be a set of spherical coefficients.

The decomposition in a spherical harmonics base can advantageously help to obtain sets of spherical coefficients that can easily be transformed by application of transformations involving a rotation.

According to one embodiment of the invention, each individual in the initial group of individuals can also be associated with a set of morphological data, and the method may also include the following steps:

- obtain current morphological data for a new individual;
- select one individual among the initial group by making a comparison between current morphological data and sets of morphological data for individuals in the initial group;
- apply a transformation to the second set of weighting factors associated with the selected individual so as to obtain a second transformed set of weighting factors, the transformation being determined from current morphological data;
- store the second transformed set of weighting factors in association with an identifier of the new individual.

Storage of sets of filters in the form of morphological data advantageously makes it easy to apply transformations so as to adapt the second set of weighting factors for an individual in the initial group. The initial group can also be used as a starting point for fast and non-restrictive determination of sets of filters for users other than users in the initial group.

In addition, the transformation may include at least the application of a rotation matrix to the set of spherical coefficients associated with the selected individual.

The application of a rotation matrix to a set of coefficients in a spherical coordinates database makes it easy to apply a rotation to the directivities of the sets of filters represented, and thus make it easy to adapt sets of filters of individuals in the initial group.

In addition, the method may also include the following steps:

- application of a homothety with N independent components, the homothety being determined from current morphological data so as to obtain N transformed independent components;
- multiplication of the transformed set of spherical coefficients by a matrix formed from N transformed independent components, in order to obtain a modified set of filters in association with the identifier of the new individual.

As a variant, the method may also include the following steps:

- multiplication of the transformed set of spherical coefficients by a matrix formed from N independent components, in order to obtain a new set of filters;
- application of a homothety by temporal resampling of the new set of filters in order to obtain a modified set of filters in association with the identifier of the new individual.

In addition, when the new set of filters is in the frequency domain, the method includes the application of an inverse Fourier transform to the new set of filters before temporal resampling.

According to one embodiment, the morphological data relate to at least one of the user's pinnas.

Thus the morphological data that have the greatest influence on the set of filters associated with an individual are used during the determination of a new set for a new individual.

Depending on the embodiment of the invention, the filters can be transfer functions in the frequency domain (or the moduli of these transfer functions), each independent component may be a function with a non-null spectrum in a given frequency band, and the given frequency bands can be distinct.

In addition, the independent components can be expressed in a logarithmic frequency scale.

The use of a logarithmic scale makes it possible to more precisely translate the perception of the human ear (more sensitive at high frequencies than at low frequencies).

According to one embodiment, for each set of filters obtained, the moduli of the set of filters can be deconvoluted by a spatial average of the moduli of the set of filters and the N independent components can be determined from deconvoluted moduli.

This embodiment can reduce the variance of filters by eliminating the part common to all filters so that work can be done on real values rather than complex values (DTF).

A second aspect of the invention relates to a computer program comprising program instructions recorded on a medium that a computer can read, to execute steps in the method according to the first aspect of the invention.

A third aspect relates to a device for processing individualized data representative of the directivity of an audio system, the device comprising a processor configured to:

- for each individual in an initial group of individuals, obtain at least one set of personalized filters through an input interface of the device;
- determine N independent components common to the sets of filters obtained;
- decompose each of the sets (or their moduli) obtained in a first base created from N independent components so as to obtain a first set of weighting factors for each set of filters;
- decompose each first set of weighting factors (or their moduli) in a second base of P independent components, so as to obtain a second set of weighting factors;
- store each second set of weighting factors obtained associated with an individual identifier among the initial group of individuals, in a memory of the device.

BRIEF DESCRIPTION OF THE DRAWINGS

Other characteristics and advantages of the invention will become clear after examining the following detailed description and the appended drawings among which.

DETAILED DESCRIPTION OF ILLUSTRATIVE EMBODIMENTS

Figure 1:
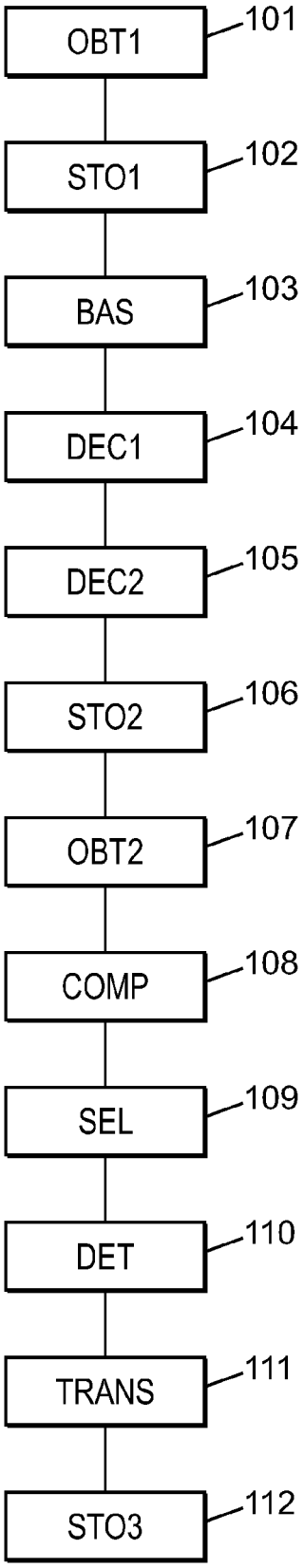
FIG. 1 is a diagram showing the steps in a data processing method according to one embodiment of this invention.

FIG. 1 is a diagram illustrating the general steps in a data processing method according to one embodiment of the invention.

In step 101, a set of personalized filters is obtained for each individual in an initial group of individuals. The initial assembly of individuals is a restricted group of individuals for which solutions according to prior art have been applied so as to obtain a set of personalized filters for each individual.

For example, tests in an anechoic chamber were performed for each individual to obtain at least one set of personalized filters. In general, two sets of personalized filters are obtained for each individual, one for each ear canal.

However, there are no restrictions on the method used to acquire the sets of filters in step 101. The sets of filters in the initial group of individuals are stored in a step 102, for example in a memory of a device making use of the method according to the invention.

The filter sets can be expressed in the form of the coefficients of a matrix. As described above, the example of HRTF transfer functions in the frequency domain is non-restrictively considered as sets of filters.

In step 103, N independent components common to the sets of filters obtained are determined. For example, the decomposition into independent components disclosed in the document entitled "Independent component analysis", Stone J. V, 2004, John Wiley & Sons, can be applied to the moduli of filters in a set (HRTF transfer functions), the moduli being optionally deconvoluted (frequency division) by the spatial average of the set of filters. Such an operation is equivalent to removing frequency components common to all filters from HRTF transfer functions. Such deconvoluted moduli are called DTF in the following. Moduli can optionally be smoothed so as to keep only frequency variations that are relevant in terms of perception.

Figure 2:
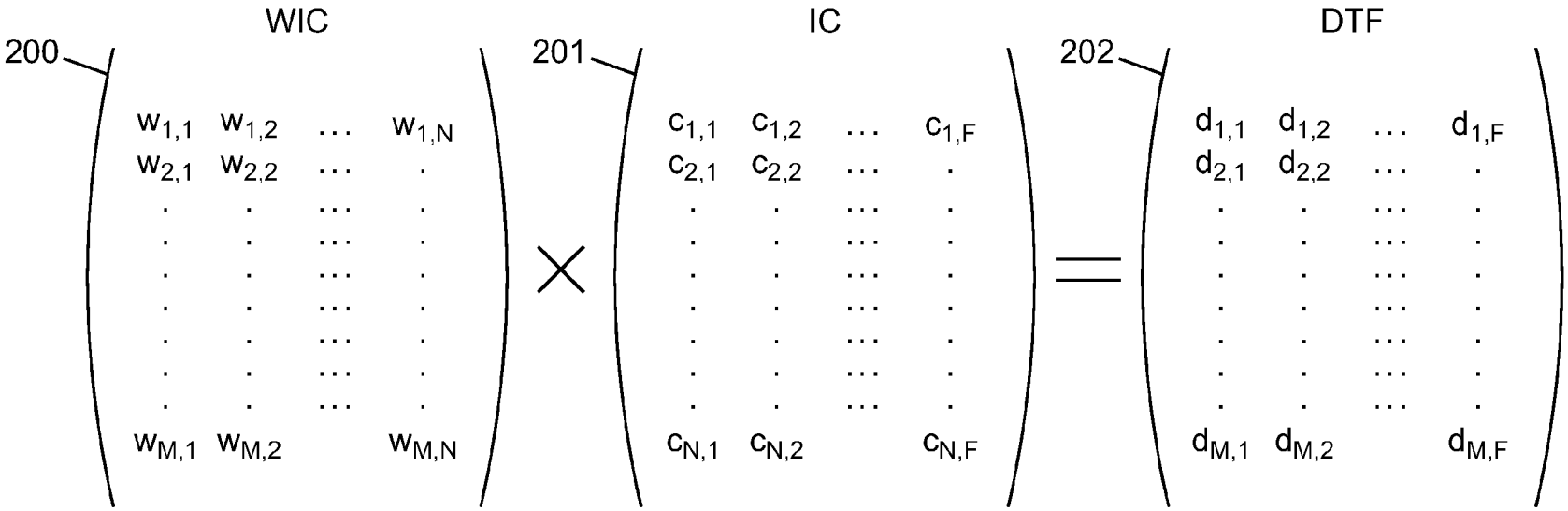
FIG. 2 represents a decomposition of a set of filters in an independent components base, according to one embodiment of the invention.

Thus, any HRTF (or DTF) transfer function among the initial group of individuals can be reconstructed by a linear combination of independent components weighted by weighting factors, as illustrated on FIG. 2.

A first matrix 200 of coefficients $w_{i,j}$, in which i varies from 1 to M (2*M being the total number of directions measured, M filters corresponding to one or two ears of the listener), and j varies from 1 to N and represents the weighting factors obtained after decomposition of the filters corresponding to one of the ears in a set on a base formed from N independent components.

A second matrix 201 of coefficients $c_{n,f}$, in which n varies from 1 to N and f varies from 1 to F represents the coefficients of N independent components, each row corresponding to one of the independent components.

A third matrix 202 represents a set of filters (the deconvoluted moduli of the HRTF transfer functions in the previous example) for one individual, for one ear, obtained in step 101, and includes coefficients $d_{m,f}$, in which m varies from 1 to M and f varies from 1 to F. Each row m in the third matrix 202 represents a filter for a given direction in space, and each column corresponds to a frequency (or more precisely a band of frequencies), thus translating the spectrum of HRTF functions. The moduli of HRTF transfer functions can be in a logarithmic or linear scale, in the abscissa or the ordinate, which results in four distinct configurations (linear, linear), (logarithmic, linear), (linear, logarithmic) and (logarithmic, logarithmic). A logarithmic scale in the abscissa is equivalent to resampling the spectrum of a transfer function (a row in the matrix 202) at a logarithmic and non-linear frequency step, which more precisely translates the perceptive functioning of the human ear (more sensitive at high frequencies than at low frequencies). A logarithmic scale in the ordinate is equivalent to considering $20*\log_{10}(\text{abs}(\text{HRTF}))$, abs(HRTF) representing the moduli of HRTF transfer functions.

As mentioned above, each row in the second matrix 201 represents an independent component, each coefficient in the row corresponding to the energy of the independent component in a given frequency band.

Figure 3:
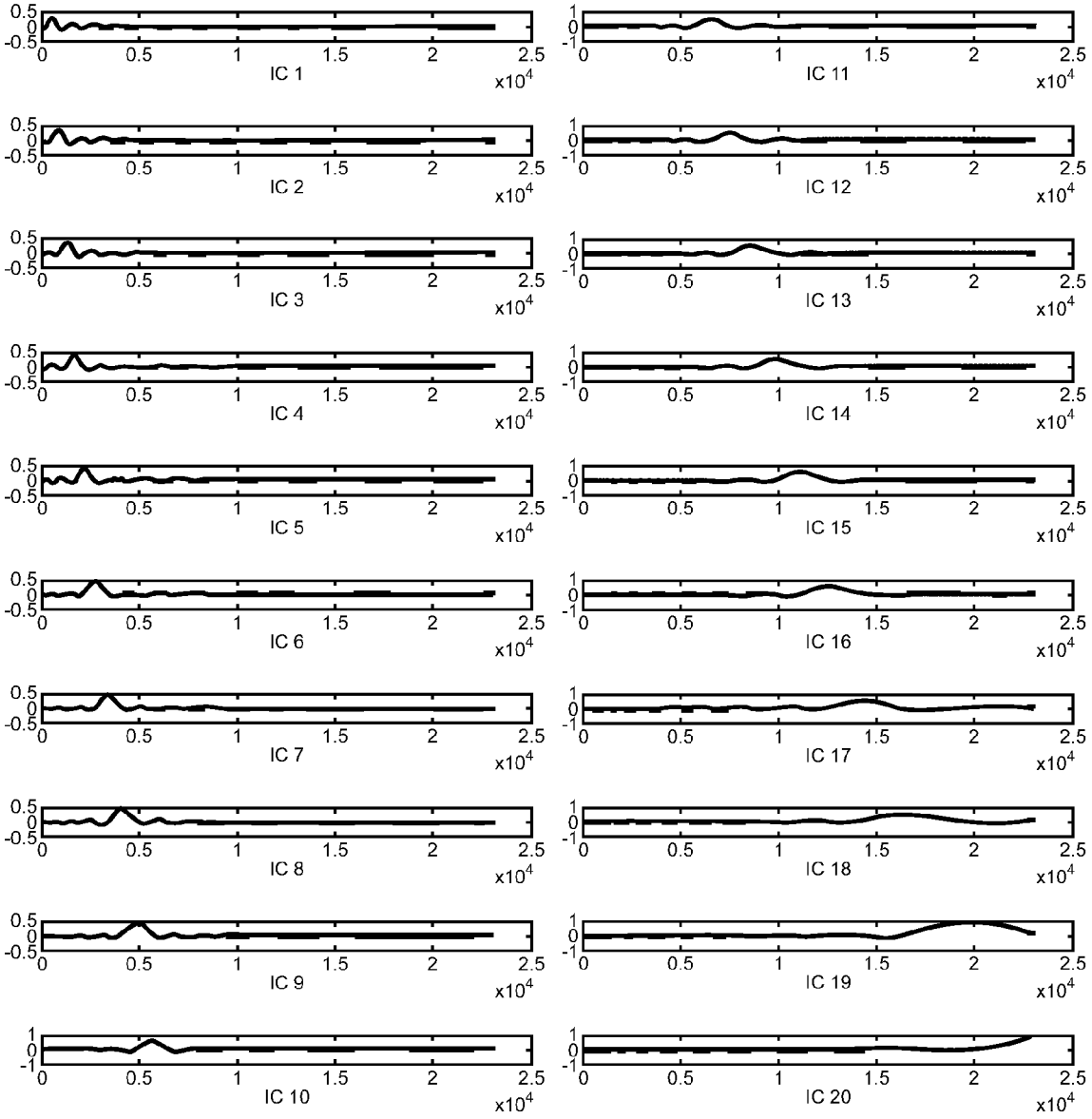
FIG. 3 represents independent components obtained from an initial collection of filter sets according to one embodiment of the invention.

FIG. 3 represents a set of spectra for N=20 independent components, according to one embodiment of the invention; These N independent components can be determined in step 103 described above, starting from the set of third matrices 202 of individuals in the initial group. As illustrated on FIG. 3, each independent component may correspond to a band of the spectrum in which energy is not zero, the independent components having disjoint spectrum supports.

The first matrix 200 depends on the azimuth and the elevation (in ordinate) and the weight assigned to each independent component (in abscissa). The group of coefficients $w_{m,n}$ for a given column n represents the directivity for an independent component for component n, for an individual. Each index m corresponding to a measurement for a direction (azimuth (m), elevation (m)). The first matrix 200 is determined in a step 104 by decomposition of each of the filter sets obtained in step 101, in the base composed of N independent components. The coefficients of a column in the first matrix 200 represent weighting values for an independent component for different measurement directions. They thus represent a spatial directivity figure.

Figure 4:
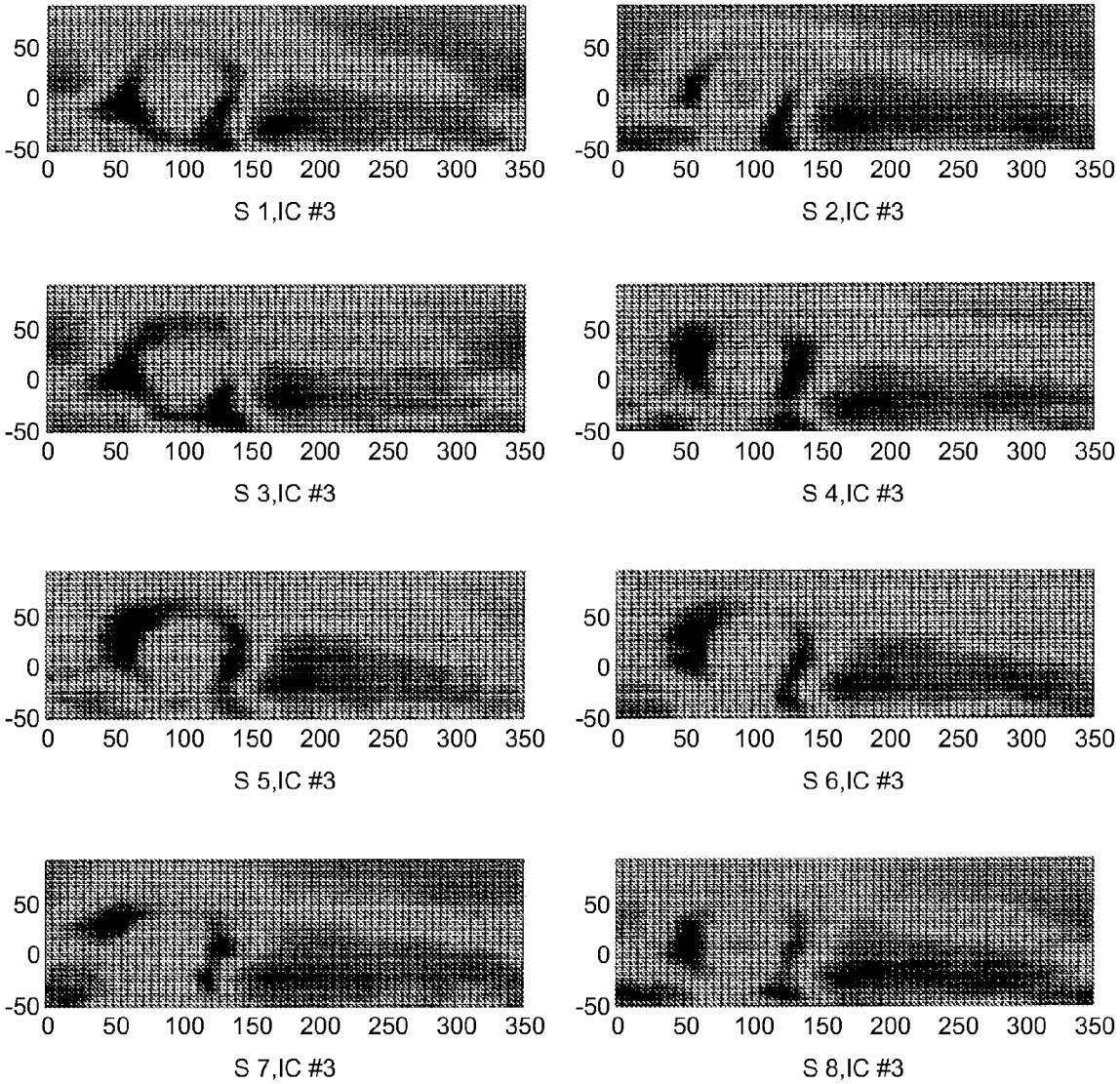
FIG. 4 illustrates directivity figures for a single independent component for eight distinct individuals, according to one embodiment of the invention.

FIG. 4 illustrates such spatial directivity figures for eight individuals from the initial group of individuals, according to one embodiment of the invention. It can be seen on FIG. 4 that the spatial directivities are similar for different individuals and that rotations can be applied to approximate these spatial directivities.

FIG. 4 presents specifically the weighting factors of the first matrix 200 for each individual, applied to the third independent component (third row in the second matrix 201) for eight different individuals. Therefore these are the third columns in each of the first matrices 200 for the eight individuals. The columns are broken down again by the same elevation and represented three-dimensionally. The abscissa corresponds to the azimuth expressed in degrees, and the ordinate corresponds to the elevation in degrees. The third dimension is represented by color variations (grey shades on FIG. 4). The grey shades represent values of weighting factors. FIG. 4 can thus be interpreted as a set of directivity figures for the third independent components of the eight individuals in the initial group.

In a step 105, the invention proposes to decompose each set of weighting factors (each first matrix 200 of an individual in the initial group) in a base of P mathematically independent functions, for example in a base of order P−1 spherical harmonics so as to obtain a set of spherical coefficients, in order to find such rotations and further reduce the quantity of information describing an individual. The choice of the base of spherical harmonics make it easy to apply rotations to the sets of spherical coefficients to recalculate a new set of spherical coefficients following a rotation of the measurement coordinate system, which is not the case for a base of independent components in two dimensions.

The determination of a set of spherical coefficients consists of making a Spatial Fourier transform of the directivities (therefore of a first matrix 200). The decomposition of directivities $cw_{ic,p}$ for the independent order P component is into spherical harmonics is expressed as follows:

$$\sum_{p=0}^{P-1} cw_{ic,p} \times HS_{m,p} = w_{m,ic}$$

in which $HS_{m,i}$ is a vector with size equal to the number of measurements and the value of which is equal to the value of the spherical harmonic i for the measurement direction corresponding to index m (azimuth (m), elevation (m))

The result obtained starting from a set of filters for an individual in the initial group is thus a set of spherical coefficients. In a step 106, each set of spherical coefficients is obtained in association with an identifier of the individual to which it corresponds.

The decomposition into spherical harmonics can thus entirely characterize a set of filters corresponding to the directivity of the ear canal of one of the individuals by means of spherical coefficients $cw_{ic,p}$ with dimensions P*N, in which P−1 is the order of the decomposition into spherical harmonics and N is the number of independent components.

The spherical harmonics base and the N independent components are common to all individuals and therefore to all sets of HRTF or DTF filters.

The successive application of a decomposition on a base of N independent components and then on a base of spherical harmonics provides a first advantage that is to reduce the quantity of information to be analyzed and makes it possible to compress sets of HRTF filters.

For example, current solutions allow for the acquisition of sets of HRTF filters comprising 1680 directions, for two ears of an individual, for a filter size of 512 points at a sampling frequency of 48 kHz, namely 1680*2*512=1720320 floating values.

A decomposition on N=64 independent components, and then on an order 20 spherical harmonics base enables a quasi-perfect reconstruction by storing only 2*64*(20+1) =2688, namely a compression factor of 640. The 64 independent components should also be stored (64*512=32768). The values of the spherical harmonics base can be calculated or stored in tables. These values and the N independent components are common to all sets of filters for individuals.

The values N and P can thus be chosen as a function of a compromise between the compression level and storage constraints, and to make sure that the complexity of HRTF transfer functions is reduced after successive decompositions.

A second advantage resulting from the successive application of a decomposition based on N independent components and then based on spherical harmonics is related to the personalization of HRTF or DTF transfer functions. Steps 101 to 106 described above were applied to an initial group of individuals, the group comprising a restricted number of individuals (for example about fifty) due to the complexity related to the acquisition of HRTF transfer functions in step 101. However, sets of spherical transfer coefficients determined for this restricted number of individuals can also be used to quickly determine a set of filters for a new individual, not belonging to the initial group. The advantage of the decomposition based on spherical harmonics is that all that is necessary to make a rotation of a collection of sets of HRTF or DTF filters (rotation of the measurement coordinate system) is to apply a rotation matrix to the corresponding set of spherical coefficients cw (for further information see the thesis "*Représentation de champs acoustiques, application à la transmission et à la reproduction de scènes sonores complexes dans un contexte multimédia* (*Representation of acoustic fields application to transmission and reproduction of complex sound scenes in a multimedia context*", Daniel J, University of Paris 6, 2000).

To achieve this, a step 107 in the method according to the invention can include obtaining current morphological data for a new individual. It is possible to change from a morphology of one individual to a morphology of a new individual by applying a transformation that can include a simple rotation defined by three rotation axes (θ, φ, ρ). A homothety λ can also be applied. The transformation parameters can be obtained by comparing two three-dimensional meshes for two individuals, and more generally by comparing the morphological data for individuals in the initial group and current morphological data for the new individual.

The parameters κ, φ, ρ and λ can also depend on a factor f representing a frequency band or a set of frequency bands.

To achieve this, morphological data for individuals in the first group can also be obtained in step 101 described above and then stored in step 102. These morphological data can describe the geometry of the linear system for which the directivity is characterized by the associated filter set.

There is no restriction attached to the means used to obtain morphological data for individuals in the initial group and current morphological data. For example, they can be obtained by making direct measurements on the individual, from photographs or for example using a Kinect™ type three-dimensional scanner. In particular, morphological data related to the individual's pinna can be used in the determination of transformation parameters. The pinna is the factor that has the greatest influence on the information in sets of HRTF filters.

Thus, in a step 108, current morphological data are compared with all morphological data for individuals in the initial group, in order to select one individual from the initial group, in a step 109. For example, the individual in the initial group with parameters most similar to current parameters is chosen. For example, considering the morphological data to be stored and compared as being 3D meshes of pinnas, a search can be made in the base for the 3D mesh that will be closest to the current 3D mesh after rotation and a homothety. There is no restriction related to the criterion used to characterize the similarity of morphological parameters.

In a step 110, a transformation to be applied to the set of spherical coefficients associated with the selected individual is determined from current morphological data. The transformation is determined by determining the first parameters used to convert from current morphological data to morphological data for the selected individual in the initial group. In the above example, the rotation values found in the previous step are used. Transformation parameters are deduced from these first parameters, to transform the set of filters for the selected individual into a new set of filters.

In general, such a method is equivalent to determining a transformation model and its parameters on sets of filters characterizing the directivities of systems from a signal point of view, another transformation model and its parameters describing the geometries, shapes or morphologies of systems, and also determining a function to make these two models correspond.

The transformation is then applied to the set of spherical coefficients associated with the selected individual to obtain a transformed set of spherical coefficients in a step 111.

The transformed set of spherical coefficients is stored in association with an identifier of the new individual in a step 112.

The homothety λ can also be applied in different ways:

frequential expansion of the N independent components of the second matrix 201 by a factor λ, then application of the matrix multiplication in FIG. 2 to obtain a new set of HRTF or DTF filters. In this calculation, the first matrix 200 is obtained from the transformed set of spherical coefficients;

application of the matrix multiplication in FIG. 2, the first matrix 200 being obtained from the transformed set of spherical coefficients, then application of an inverse Fourier transform to return to the temporal domain, and application of the homothety λ by temporal resampling. The inverse Fourier transform is thus applied in the particular example of sets of HRTF or DTF filters. However, it is not necessary in the case in which the invention is applied to sets of filters in the temporal domain.

Figure 5:
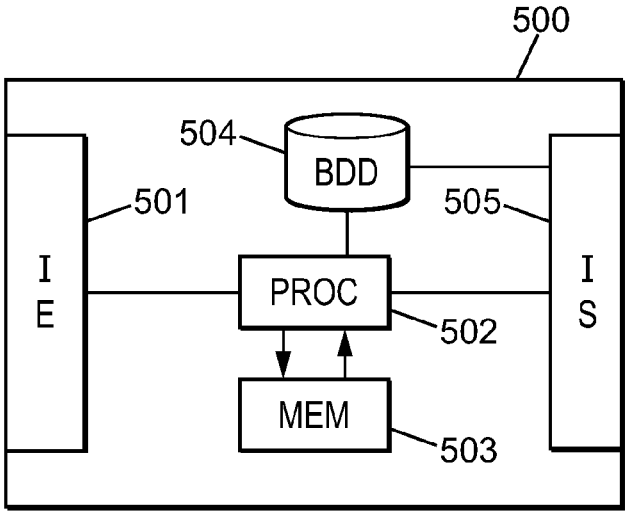
FIG. 5 illustrates a device according to one embodiment of the invention.

FIG. 5 represents a device 500 according to one embodiment of the invention.

The device 500 comprises a RAM memory 503 and a processor 502 to store instructions so that steps 101 to 112 in the process described above with reference to FIG. 1 can be performed. The device also comprises a database 504 for storage of data that are to be kept after application of the method, particularly sets of spherical coefficients, independent components, and optionally the spherical harmonics base. The device 500 also comprises an input interface 501 that will receive sets of filters from the initial group of individuals, and optionally the morphological parameters of individuals in the initial group and current morphological parameters. The device 500 also comprises an output interface 505 for transmission of data resulting from application of the method according to the invention. For example, the output interface can transmit the modified set of filters or the transformed set of spherical coefficients obtained for the new user.

This invention is not limited to the embodiments described above as examples; it covers other variants.

Thus, this invention can improve the quality of immersive audio rendering in binaural systems, because it makes it easy to obtain a set of personalized filters for an individual, starting from morphological data, without the need for long and expensive measurements on each individual. The invention is thus applicable to communication services including audio conferences and content broadcasting services or applications (music, films, games, user interfaces, etc.). Moreover, this invention enables compression of sets of filters (for example HRTF or DTF filters), which facilitates storage, exchange and loading of these filter sets.

The invention claimed is:

1. A method of processing individualized data representative of directivity of an individualized audio system, said method comprising the following operations:

for each individual in an initial group of individuals, obtain at least one set of personalized filters;

determine N independent components common to the sets of filters obtained;

decompose each of the sets obtained in a first base created from N independent components so as to obtain a first set of weighting factors for each set of filters;

decompose each first set of weighting factors in a second base of P independent components, so as to obtain a second set of weighting factors;

store each second set of weighting factors obtained associated with an individual identifier among the initial group of individuals;

wherein each individual in the initial group of individuals is also associated with a set of morphological data, said method also including the following operations:

obtain current morphological data for a new individual;

select one individual among the initial group by making a comparison between current morphological data and sets of morphological data for individuals in the initial group;

apply a transformation to the second set of weighting factors associated with the selected individual so as to obtain a second transformed set of weighting factors, the transformation being determined from current morphological data;

store the second transformed set of weighting factors in association with an identifier of the new individual.

2. The method according to claim 1, wherein the second base of P independent components is an order P spherical harmonics base and the second set of weighting factors is a set of spherical coefficients.

3. The method according to claim 1, wherein the second base of P independent components is an order P spherical harmonics base and the second set of weighting factors is a set of spherical coefficients, in which the transformation includes at least the application of a rotation matrix to the set of spherical coefficients associated with the selected individual.

4. The method according to claim 3, in which the method also includes the following operations:

application of a homothety with N independent components, said homothety being determined from current morphological data so as to obtain N transformed independent components;

multiplication of the transformed set of spherical coefficients by a matrix formed from N transformed independent components, in order to obtain a modified set of filters in association with the identifier of the new individual.

5. The method according to claim 3, in which the method also includes the following operations:

multiplication of the transformed set of spherical coefficients by a matrix formed from N independent components, in order to obtain a new set of filters;

application of a homothety by temporal resampling of the new set of filters in order to obtain a modified set of filters in association with the identifier of the new individual.

6. The method according to claim 5, in which when the new set of filters is in the frequency domain, the method includes the application of an inverse Fourier transform to the new set of filters before temporal resampling.

7. The method according to claim 1, in which the morphological data relate to at least one of the user's pinnas.

8. The method according to claim 1, in which the filters are transfer functions in the frequency domain, in which each independent component is a function with a non-null spectrum in a given frequency band, and in which the given frequency bands are distinct.

9. The method according to claim 8, in which the independent components are expressed in a logarithmic frequency scale.

10. The method according to claim 1, in which for each set of filters obtained, moduli of the set of filters are deconvoluted by a spatial average of the moduli of the set of filters and in which the N independent components are determined from deconvoluted moduli.

11. A non-transitory computer readable storage medium, with a program stored thereon, said program comprising program instructions, which when executed by a processor configure the processor to execute a method of processing individualized data representative of directivity of an individualized audio system, said method comprising the following operations:

for each individual in an initial group of individuals, obtain at least one set of personalized filters;

determine N independent components common to the sets of filters obtained;

decompose each of the sets obtained in a first base created from N independent components so as to obtain a first set of weighting factors for each set of filters;

decompose each first set of weighting factors in a second base of P independent components, so as to obtain a second set of weighting factors;

store each second set of weighting factors obtained associated with an individual identifier among the initial group of individuals, wherein each individual in the initial group of individuals is also associated with a set of morphological data, said method also including the following operations:

obtain current morphological data for a new individual;

select one individual among the initial group by making a comparison between current morphological data and sets of morphological data for individuals in the initial group;

apply a transformation to the second set of weighting factors associated with the selected individual so as to obtain a second transformed set of weighting factors, the transformation being determined from current morphological data;

store the second transformed set of weighting factors in association with an identifier of the new individual.

12. A device for processing individualized data representative of directivity of an audio system, said device comprising a processor configured to:

obtain at least one set of personalized filters through an input interface of the device, for each individual in an initial group of individuals;

determine N independent components common to the sets of filters obtained;

decompose each of the sets obtained in a first base created from N independent components so as to obtain a first set of weighting factors for each set of filters;

decompose each first set of weighting factors in a second base of P independent components, so as to obtain a second set of weighting factors;

store each second set of weighting factors obtained associated with an individual identifier among the initial group of individuals, in a memory of the device, wherein each individual in the initial group of individuals is also associated with a set of morphological data, the processor being further configured to:

obtain current morphological data for a new individual;

select one individual among the initial group by making a comparison between current morphological data and sets of morphological data for individuals in the initial group;

apply a transformation to the second set of weighting factors associated with the selected individual so as to obtain a second transformed set of weighting factors, the transformation being determined from current morphological data;

store the second transformed set of weighting factors in association with an identifier of the new individual.

* * * * *